US006934990B2

(12) United States Patent
Rapisarda

(10) Patent No.: US 6,934,990 B2
(45) Date of Patent: Aug. 30, 2005

(54) NON-LIQUID BUOYANT BEDDING

(76) Inventor: Tom Rapisarda, 9334 Wampler St., Pico Rivera, CA (US) 90660

( * ) Notice: Subject to any disclaimer, the term of this patent is extended or adjusted under 35 U.S.C. 154(b) by 187 days.

(21) Appl. No.: 10/327,326

(22) Filed: Dec. 20, 2002

(65) Prior Publication Data

US 2004/0117911 A1 Jun. 24, 2004

(51) Int. Cl.[7] ..... A47C 27/08
(52) U.S. Cl. ..... 5/702; 5/655.4; 5/911
(58) Field of Search ..... 5/702, 644, 654, 5/911, 655.4, 689, 912

(56) References Cited

U.S. PATENT DOCUMENTS

| | | | | | |
|---|---|---|---|---|---|
| 3,459,179 | A | | 8/1969 | Olesen | 601/134 |
| 3,762,404 | A | * | 10/1973 | Sakita | 602/6 |
| 3,840,920 | A | | 10/1974 | Voelker | 5/702 |
| 3,899,210 | A | * | 8/1975 | Samhammer et al. | 297/448.2 |
| 3,968,530 | A | * | 7/1976 | Dyson | 5/676 |
| 4,027,888 | A | * | 6/1977 | Wilcox | 297/452.17 |
| 4,055,866 | A | | 11/1977 | Evans | 5/655.4 |
| 4,254,518 | A | | 3/1981 | Buhren et al. | 5/702 |
| 4,498,205 | A | * | 2/1985 | Hino | 5/689 |
| 4,564,965 | A | * | 1/1986 | Goodwin | 5/689 |
| 4,607,403 | A | | 8/1986 | Alivizatos | 5/655 |
| 4,657,003 | A | * | 4/1987 | Wirtz | 128/869 |
| 4,667,356 | A | | 5/1987 | Holmquist | 5/655 |
| 4,675,930 | A | * | 6/1987 | Sargent | 5/655.4 |
| 4,754,511 | A | | 7/1988 | Sargent | 5/655.4 |
| 4,776,050 | A | * | 10/1988 | Goodwin | 5/689 |
| 4,879,777 | A | * | 11/1989 | Goodwin | 5/689 |
| 4,916,767 | A | * | 4/1990 | Uetake et al. | 5/689 |
| 5,001,794 | A | * | 3/1991 | Uetake et al. | 5/689 |
| 5,107,558 | A | | 4/1992 | Lück | 5/727 |
| 5,881,409 | A | | 3/1999 | Pearce | 5/702 |
| 6,192,537 | B1 | | 2/2001 | Miki | 5/689 |
| 6,226,820 | B1 | * | 5/2001 | Navarro | 5/655.5 |
| 6,308,353 | B1 | * | 10/2001 | Van Steenburg | 5/632 |
| 6,611,980 | B2 | * | 9/2003 | Wempe | 5/654 |
| 6,857,151 | B2 | * | 2/2005 | Jusiak et al. | 5/655.4 |
| 2003/0200609 | A1 | * | 10/2003 | Jusiak et al. | 5/655.4 |
| 2003/0221260 | A1 | * | 12/2003 | McGrath | 5/655.4 |
| 2004/0117911 | A1 | * | 6/2004 | Rapisarda | 5/702 |

FOREIGN PATENT DOCUMENTS

| | | | | | |
|---|---|---|---|---|---|
| DE | 2205937 | A | * | 8/1973 | |
| EP | 317009 | A | * | 5/1989 | A61G/7/04 |
| EP | 606670 | A1 | * | 7/1994 | A61G/7/057 |

* cited by examiner

*Primary Examiner*—Robert G. Santos
(74) *Attorney, Agent, or Firm*—Knobbe, Martens, Olson & Bear, LLP

(57) ABSTRACT

A bed includes a frame supporting a non-liquid material having a density of about 0.15 of to 1 times the density of water. The material can be formed from pellets. The bed can also include a stretchable sheet disposed over the material.

15 Claims, 9 Drawing Sheets

NON-LIQUID BUOYANT BEDDING

BACKGROUND OF THE INVENTION

1. Field of the Invention

The present invention is directed to mattresses, and in particular, non-liquid buoyant mattresses.

2. Description of the Related Art

The human body includes irregular contours. When the body lays on a relatively hard flat surface, those portions which protrude the furthest from the central axis of the body, make contact with the surface and bear the full load of the body. Thus, mattresses have long been designed to form around the curvatures of the human body so as to be more comfortable. However, a conventional mattress made of padding and springs necessarily applies a greater pressure to the contours of the body which protrude the furthest from the central axis of the body. These portions of the body are subjected to the highest stresses and thus experience discomfort more readily than other portions of the body.

Waterbeds have long been known to provide more uniform distribution of support. However, waterbeds have been criticized for their substantial weight, as well as the serious damage that results when a waterbed leaks.

SUMMARY OF THE INVENTION

One aspect of the present invention includes the realization that the buoyancy of a waterbed can be recreated using non-liquid material. With respect to waterbeds, one reason why waterbeds are particularly comfortable is because the human body is roughly the same density as water at sea level. Thus, when the human body is at rest on a body of water, it floats near the surface of the water. The reason why the human body floats as such is because the weight of the water displaced by the body is equal to the weight of the body itself.

A conventional waterbed is formed with a thick plastic bag filled with water and sealed. When one lays on a waterbed, the stiffness of the bag prevents the surface of the water from closely following the various contours of the body, thus displacing additional water than what would be displaced by a body floating directly in water. This additional amount of displaced water causes the body to float somewhat higher relative to the remaining free surface of the waterbed mattress surrounding the body, then a body floating freely in water. Because the bag has a watertight seal, the pressure inside the bag rises when one lays on a waterbed. This additional pressure also contributes to a higher position relative to the surface of the water.

Additionally, waves travel through and are reflected within waterbeds. Thus, if two people are resting on a waterbed, waves generated by one person impact the other. Additionally, if one person accidentally falls on the bed, a more severe shock can be transferred to the other person. As such, those who are vulnerable to motion sickness do not enjoy the benefits of waterbeds.

By constructing a bed with non-liquid material having a density that is about the same density as water, the bed achieves the dual goals of providing a buoyant effect similar to that of a waterbed and preventing the transfer and/or reflection of wave energy associated with waterbeds. Further, such a material avoids the risk of serious water damage posed by a waterbed.

Where the material is a plastic, the lower coefficients of friction associated with plastic materials, such as, for example, but without limitation, polypropylene, provide a further advantage in that the material can flow under a body supported by the material when the body is in motion. However, with such a material, the coefficient of friction can be sufficiently high that when a body is resting on the material, the material can resist movement so as to allow a user to reconfigure the upper contour of the material and rest on the reconfigured contour.

Other known bed designs have included plastic beads encased in fabric cushions. However, where the density of the beads is substantially less than that of water, the cushion does not provide sufficient buoyancy to provide a comfortable sleeping surface. In particular, when the density of the material filling the mattress is too low, the weight of one's body will force the beads away from the body. Thus, the heaviest portions of the body will further sink into the cushion over time. Thus, if one were to attempt to sleep on such a bed, one might wake up in an uncomfortable position, perhaps with their head and feet elevated and their pelvis sunk deeply into the cushion. However, where the bed includes material that has a density that is about the same as water, the material keeps ones body floating thereon.

Thus, in accordance with another aspect of the present invention, a bed comprises a plurality of beads having a density of about 0.15 of to 1 times the density of water and a frame configured to support the plurality of beads.

In accordance with a further aspect of the present invention, a bed comprises a frame defining a reservoir having at least a bottom wall and a plurality of sidewalls defining an upward opening. A plurality of beads are contained within the reservoir. A stretchable sheet material is disposed over the upward opening and the plurality of beads. The beads have a density of about 0.15 of to 1 times the density of water and a coefficient of friction sufficiently low to allow the beads to slide against and flow relative to each other in the reservoir when a body is supported on top of the sheet material and by the beads.

BRIEF DESCRIPTION OF THE DRAWINGS

These and other features, aspects and advantages of the present invention will now be described with reference to the drawings of a preferred embodiment, which embodiment is intended to illustrate and not to limit the invention, and in which figures.

DETAILED DESCRIPTION OF THE PREFERRED EMBODIMENT

Figure 1:
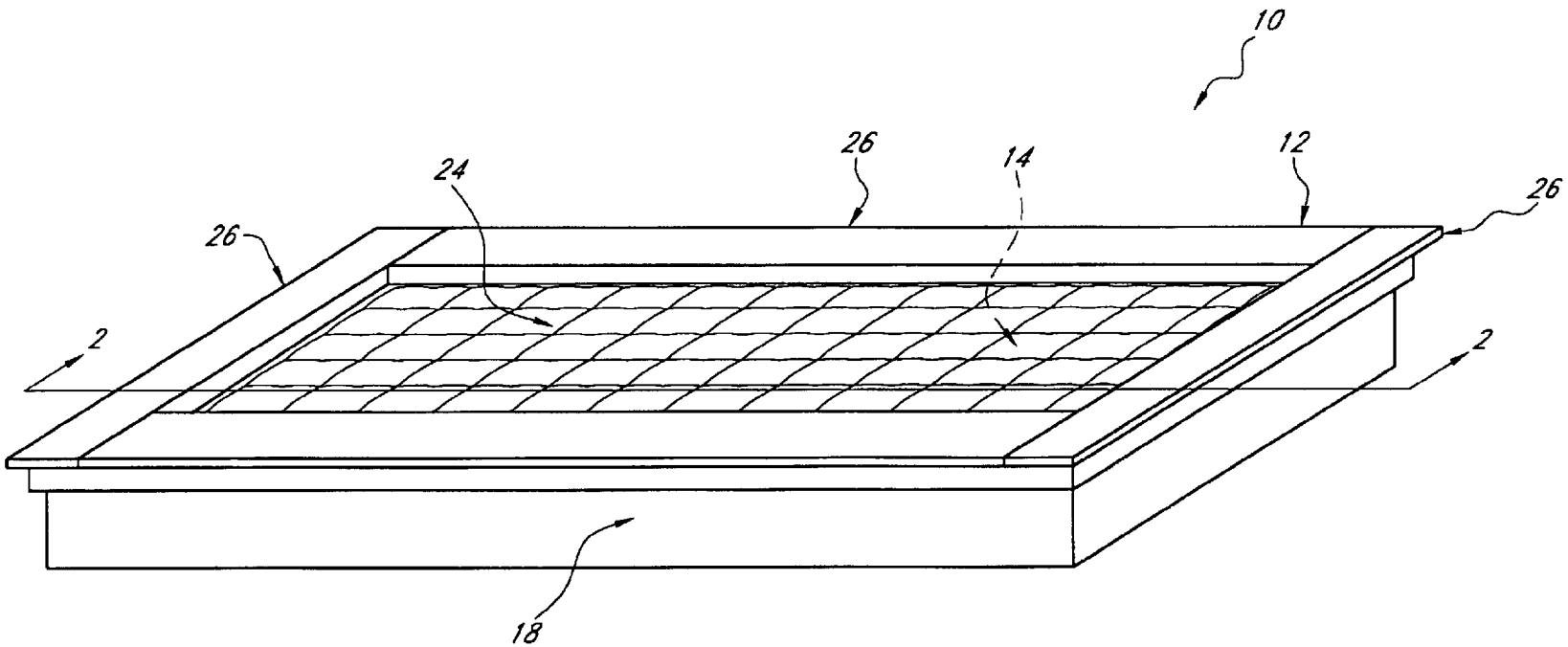
FIG. 1 is a front, top, and left side perspective view of a bed constructed in accordance with an embodiment of the present invention.
Figure 2:
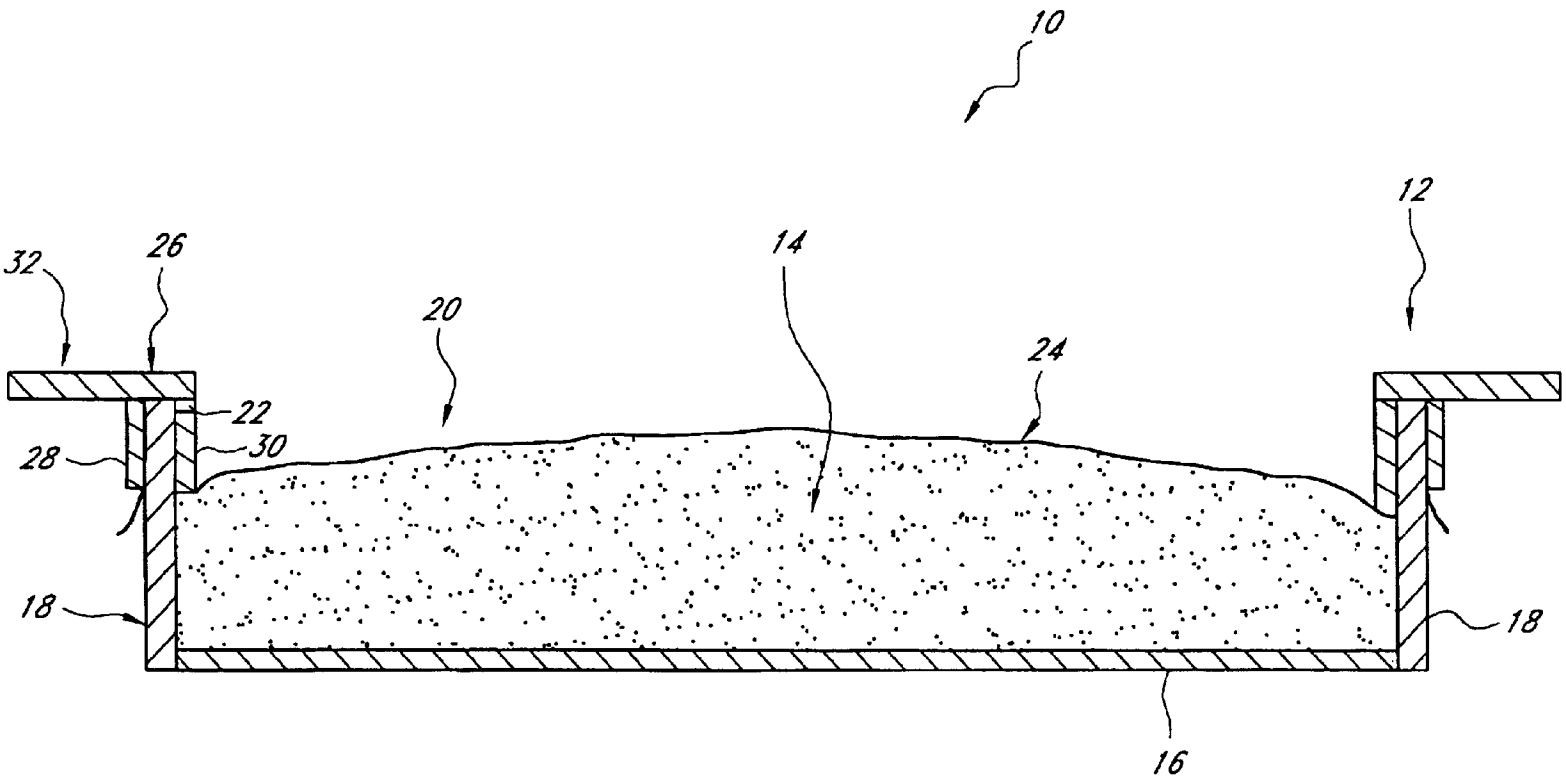
FIG. 2 is a sectional view of the bed shown in FIG. 1, taken along line 2—2 of FIG. 1.
Figure 2A:
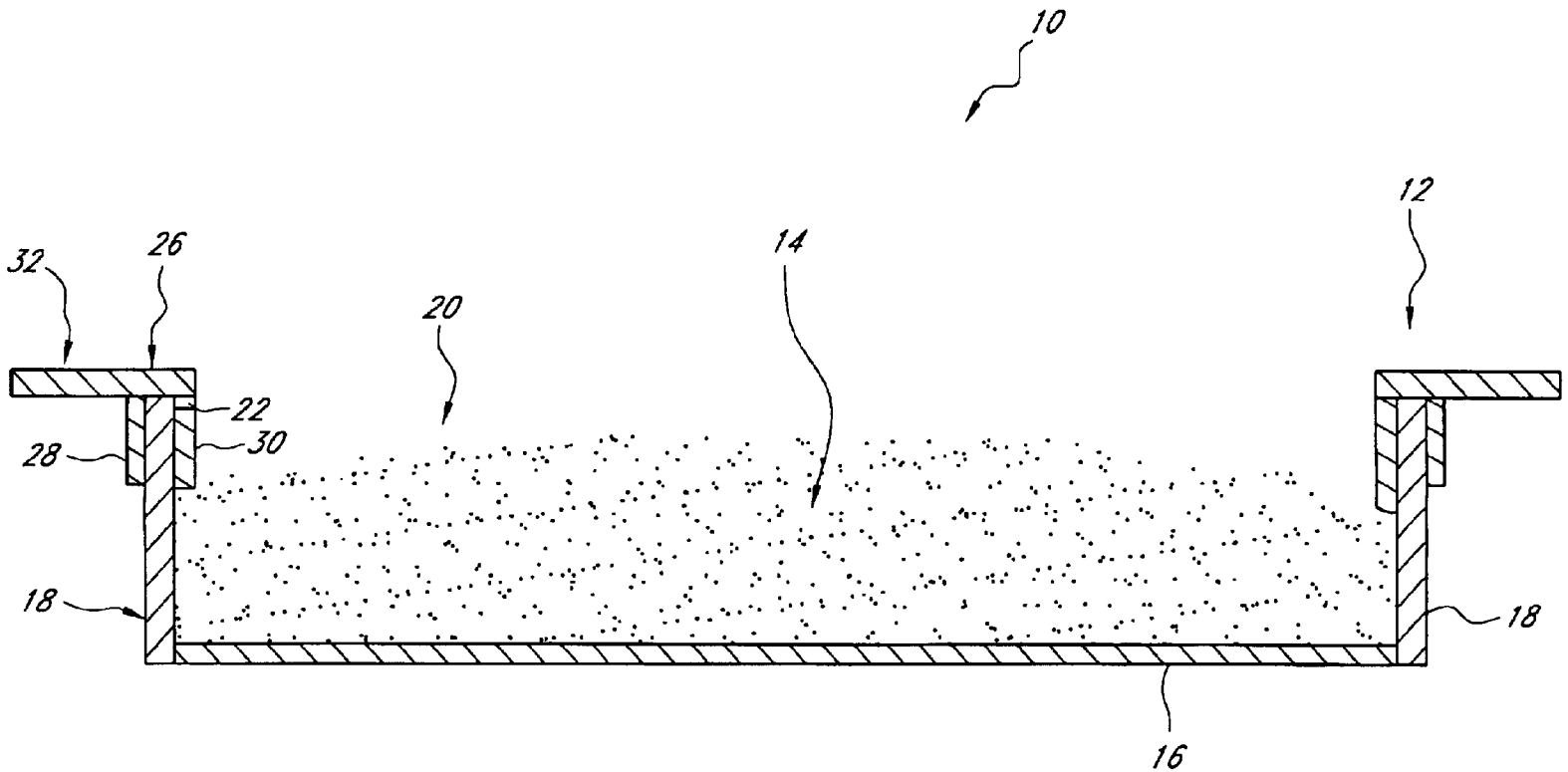

With reference to FIGS. 1 and 2, a bed 10 is constructed in accordance with preferred embodiments of the inventions disclosed herein. The bed 10 includes a frame assembly 12 which supports a material 14 having an effective volumetric density of about 0.15 of to 1 times the density of water, e.g., the weight of the amount of the material 14 needed to fill a one-gallon container is about 0.15 to 1 times the weight of one-gallon of water.

With reference to FIG. 2, the frame assembly 12 comprises a lower wall 16 and a plurality of side walls 18. Together, the walls 16, 18 define a reservoir 20 configured to retain the material 14. In the illustrated embodiment, the walls 18 extend generally upwardly. An upper periphery 22 of the walls 18 define an upward opening of the reservoir 20.

The walls 16, 18, can be made from wood, steel, any other metal or alloy material, plastic, or an inflatable structure similar to a small pool. For example, but without limitation, the frame assembly 12 can be constructed in the same manner as a waterbed frame. Additionally, the frame assembly 12 can include a riser (not shown) for supporting the frame assembly 12 above the ground.

The material 14 preferably comprises a plastic material such as polyethylene. Preferably, the polyethylene is in the form of a plurality of pellets having a size of approximately $1/128^{th}$ of an inch to 2 inches in diameter. The pellets can be of any shape, for example, but without limitation, including spherical, hourglass, cubic, etc. Preferably, the outer surface of the pellets is smooth and includes rounded features. Thus, the pellets can more easily slide against each other, described below in greater detail. The pellets can be made from other materials, for example, but without limitation, plastics, wood, and organic materials.

The bed 10 also includes a sheet 24 disposed over the material 14. As shown in FIG. 2, the sheet 24 is disposed over the material 14 and the upper periphery 22 of the frame assembly 12.

The sheet 24 preferably is stretchable in all directions. For example, but without limitation, the sheet 24 can be made from a material known as Lycra®. However, the sheet 24 could be made from any stretchable material, for example, spandex, cotton, nylon, rubber, and plastic. Additionally, it is preferable that the sheet 24 is anchored in a loose state so that when one is lying on the bed, the sheet 24 does not generate high tensions therein.

The sheet 24 is attached to the periphery 22 of the walls 18. In the illustrated embodiment, a channel assembly 26 anchors the sheet 24 to the periphery 22 of the walls 18.

The channel assembly 26 includes a pair of opposed leg portions 28, 30 which are spaced to straddle the periphery 22 of the walls 18. Preferably, the legs 28, 30 are spaced so as to provide an interference fit over the sheet 24 and the periphery 22. As shown in FIG. 1, the channel assembly 26 extends around the entire upper periphery 22 of the walls 18. As such, the channel assembly 26 provides a uniform anchoring effect to the periphery of the sheet 24. Optionally, the sheet 24 can be anchored to the frame with Velcro®, laces, ties, zippers, clamps, or can be stitched into place.

Preferably, the channel assembly 26 includes an upper member 32 which defines a substantially horizontal border around the upper periphery 22. In the illustrated embodiment, the legs 28, 30 are attached to the upper member 32. Thus, a user can grab the upper member 32 to remove the channel assembly 26 from the periphery 22. Optionally, the upper member 32 can be padded.

Figure 3:
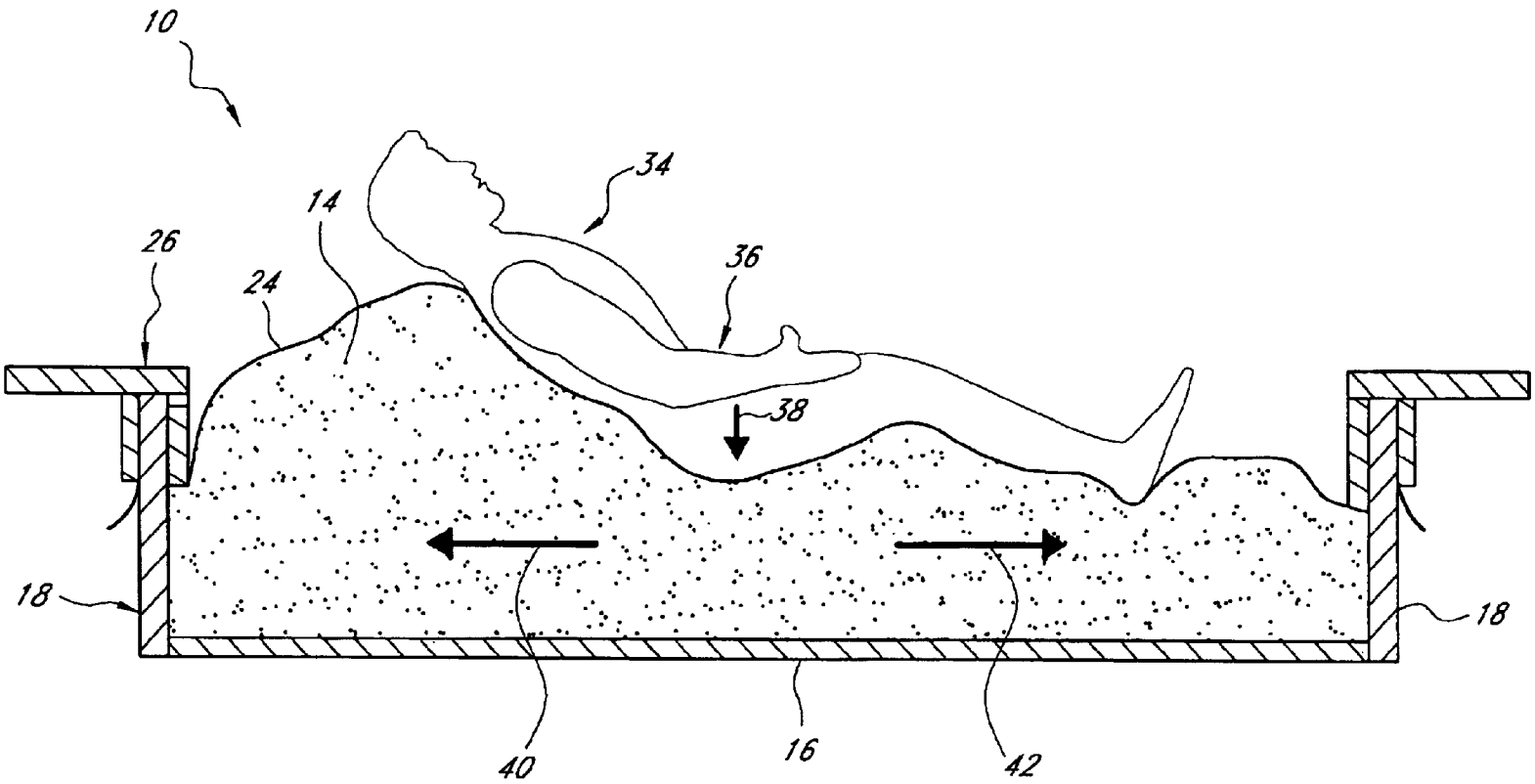
FIG. 3 is a sectional view of the bed shown in FIG. 1, taken along line 2—2, illustrating a flow of beads inside the bed when displaced initially by a person sitting on the bed.
Figure 3A:
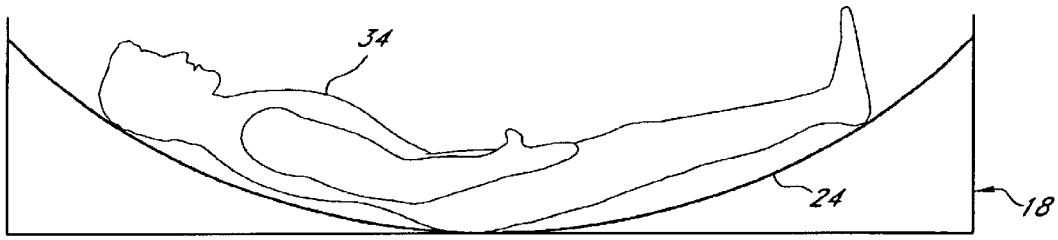
FIG. 3A is a sectional view of the bed shown in FIG. 3, illustrating a "hammock effect"

With reference to FIG. 3, when a person 34 moves toward a sitting-up position, the weight of the person 34 concentrates in the vicinity of their pelvis 36. Thus, their pelvis 36 tends to sink downwardly in the direction of arrow 38. The sinking motion causes the material 14 to move away from the person's pelvis 36, in the direction of arrows 40, 42.

Figure 4:
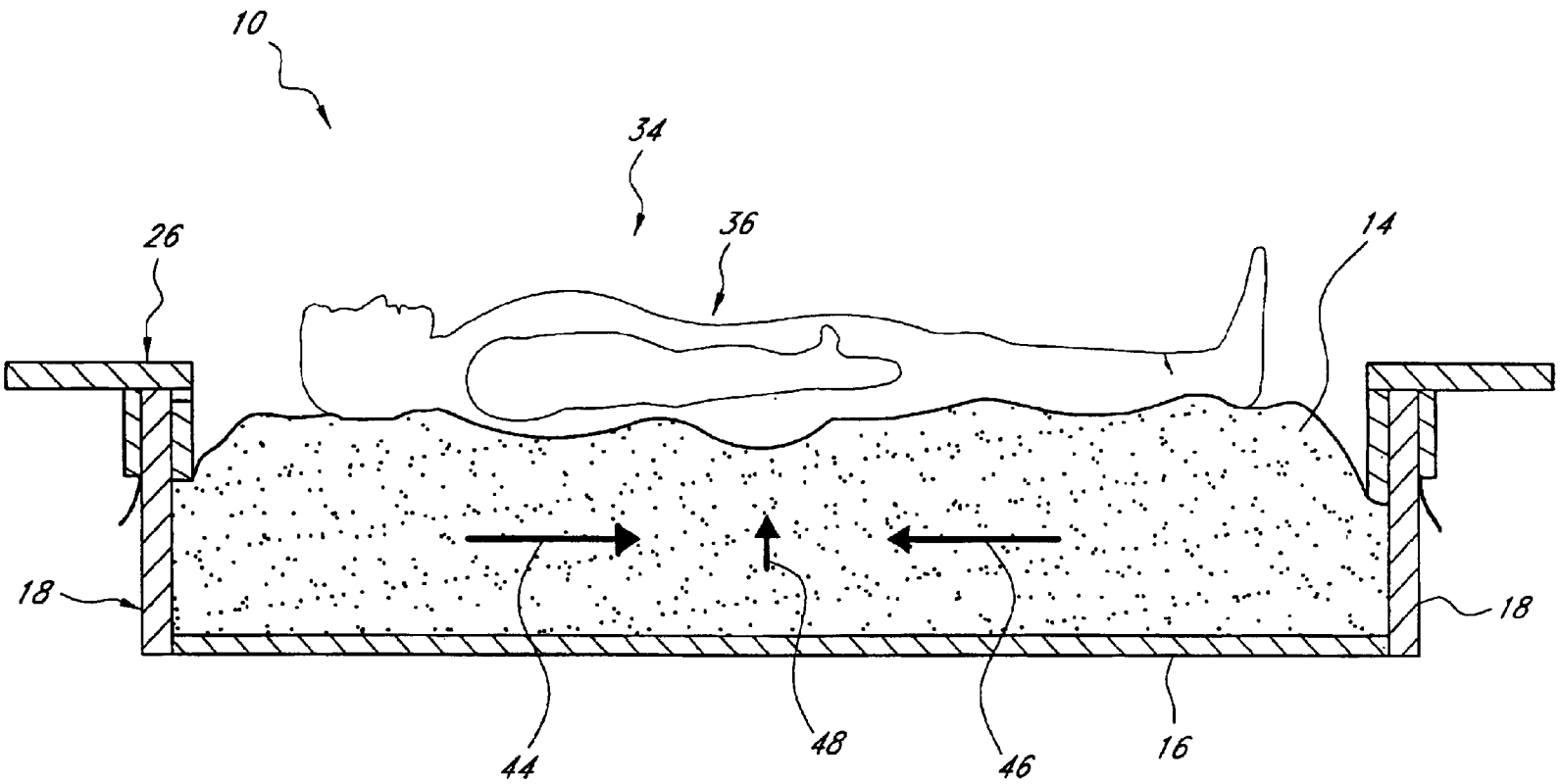
FIG. 4 is a sectional view of the bed illustrated in FIG. 1, taken along line 2—2, illustrating a flow of beads within the bed when one moves from a sitting position to a lying-down position.

With reference to FIG. 4, when the person 34 returns to a horizontal position, as illustrated in FIG. 4, the buoyant effect of the material 14 aids in causing a return flow of the material 14 toward the pelvis of the person 34. For example the arrows 44, 46 schematically illustrate a flow of the material 14 toward the pelvis 36 of the person 34. This flow of the material 14 aids in raising the person's pelvis 36, in the direction of arrow 48, to return the person 34 to a normal lying down position.

As noted above, the buoyancy created by the material 14 is responsible for providing a restoring flow of material to positions under the pelvis 36 which was previously excessively sunken into the bed 10. It is to be noted that the flows of the material 14 illustrated in FIGS. 3 and 4 have been exaggerated for illustrative purposes only.

Where the material 14 has a density that is below 0.15 the density of water, the person 34 tends to sink into the material 14 deeper and deeper over time. Because the density of the material is substantially below the density of water, sufficient return flows are not generated when the user moves from a sitting up position (FIG. 3) to a lying down position (FIG. 4). With such a material, as a person 34 moves during sleep, their body will tend to sink into such material through their sleeping period, thereby allowing the body to shift into an uncomfortable position. If the body sinks sufficiently deep to cause tension in the sheet 34, a "hammock effect" can be generated, causing further discomfort to the person 34. The resulting position of the person 34 can cause them to wake up in an uncomfortable position.

Where the material 14 has a density substantially above that of water, the resulting bed is excessively stiff and is not comfortable. However, by using the material 14 that has a density of about 0.15 of to 1 times the density of water, the weight of the material 14 causes the material to move and thus provide a buoyant effect, similar to that of water. Thus, the bed 10 can be at least as comfortable as water, without the risk of a leak causing any of the damage associated with leaking waterbeds. Such pellets are commercially available from Plasco Incorporated as polypropylene 8-12 MI.

Including such pellets into the bed 10 provides a further advantage in that the resulting coefficient of friction provides a desirable stabilizing effect. For example, with reference to FIGS. 5–7, the pellets 14 can be pushed into a desired contour. Due to the relative friction between the pellets 14, the pellets 14 can substantially retain the contour, despite the gravitational forces acting on the pellets 14 and despite the weight of the person 34. Thus, the bed can be reconfigured to support the person 34 at different angles, unlike waterbeds, or any other type of adjustable bed.

Figure 5:
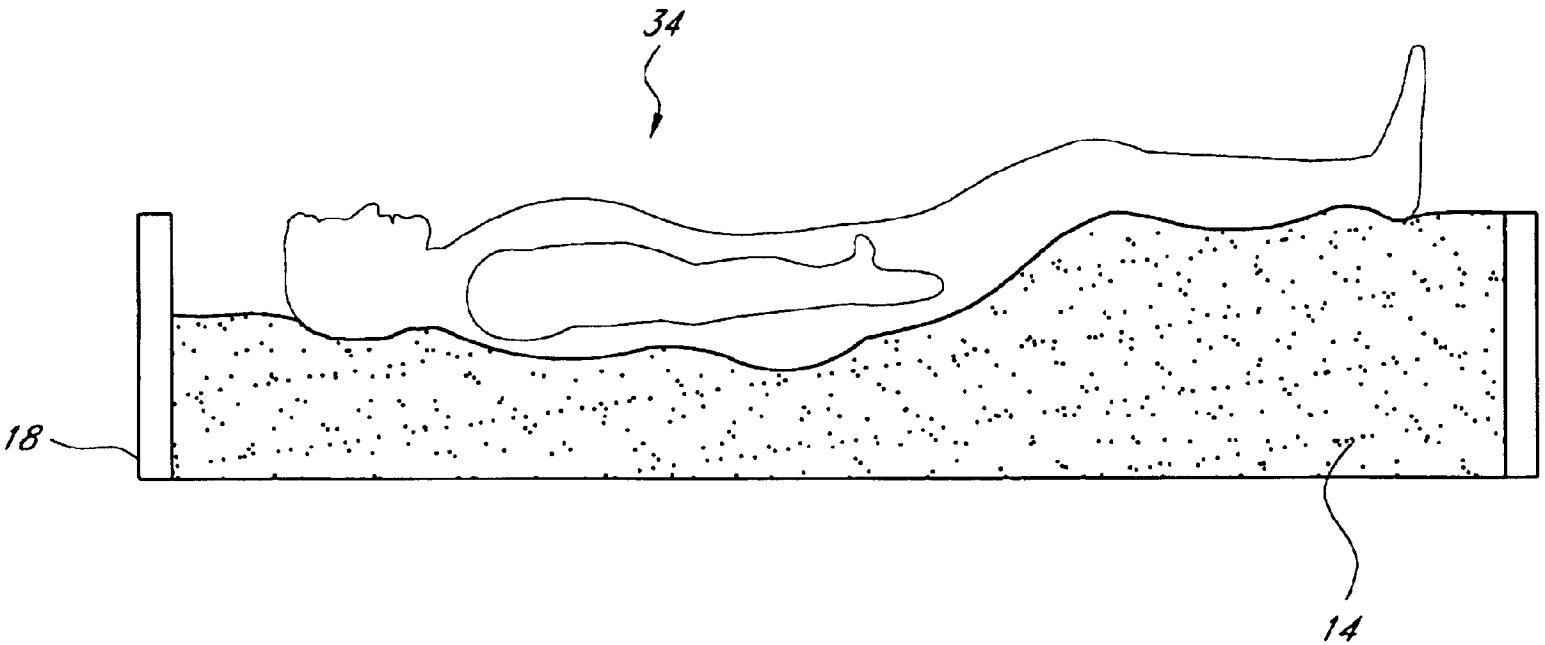
FIG. 5 is another sectional view of the bed illustrated in FIG. 1, illustrating a user lying on the bed with the upper surface of the bed being configured with a contour spreading the legs of the user in an elevated position.

With reference to FIG. 5, in certain circumstances, a user may want to lie in the bed 10, with their feet elevated. Thus, the user can push some of the pellets 14 into a pile near the lower end of the bed 10. Due to the friction between the pellets 14, the pellets substantially retain the piled shape, and allow the person 34 to rest their legs on the pile of pellets 34, substantially indefinitely.

Figure 6:
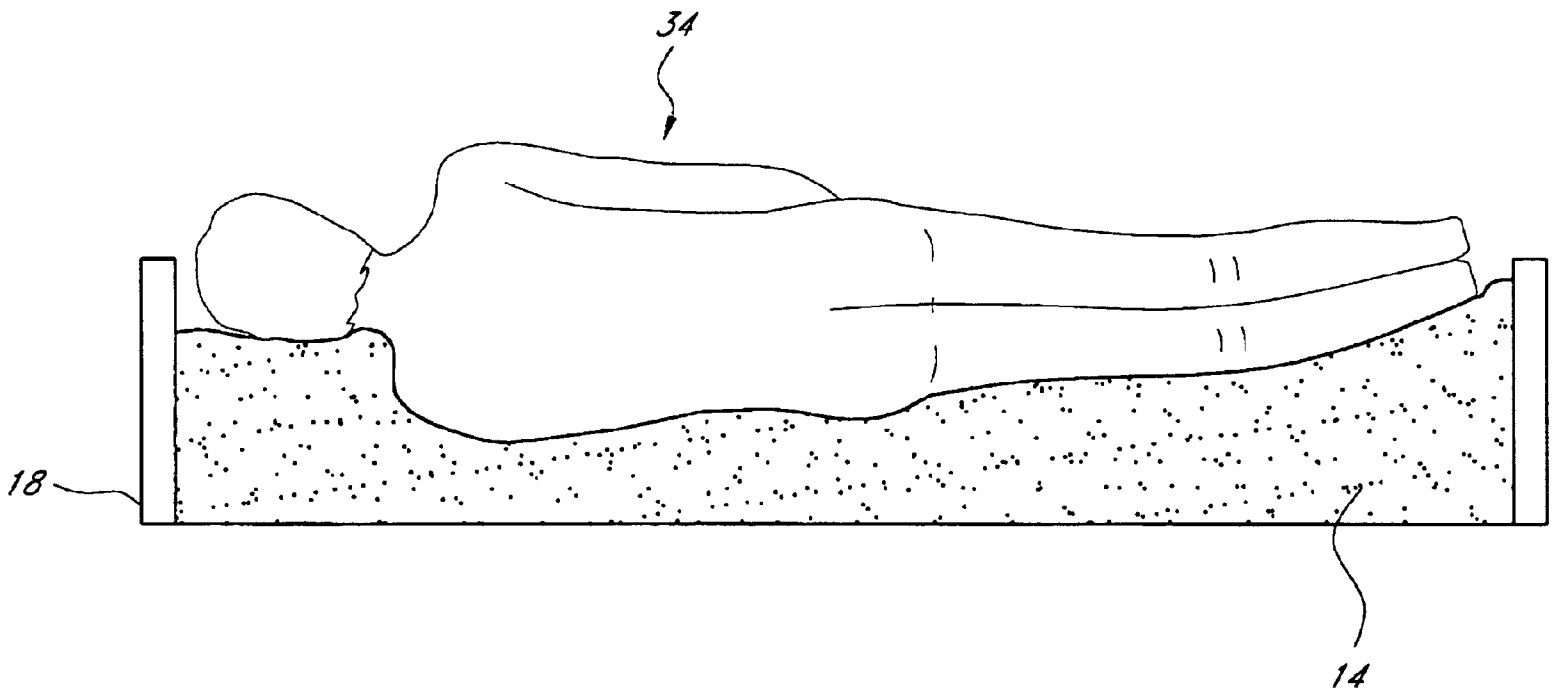
FIG. 6 is another sectional view of the bed illustrated in FIG. 1, illustrating a user lying on the bed with the upper surface of the bed being configured with a contour providing a recess for the shoulder and the hips of the user.

Similarly, as shown in FIG. 6, a user may want to lie on their side, without a pillow supporting their head. Thus, the user can create a recess in the pellets 14 near their shoulder, and lie on the pellets with their shoulder received in the recess. Due to the friction between the pellets 14, the pellets retain the recessed configuration, allowing the person 34 to lie on their side, with the shoulder comfortably received within the recess, and their head supported by the pellets without a pillow.

Figure 7:
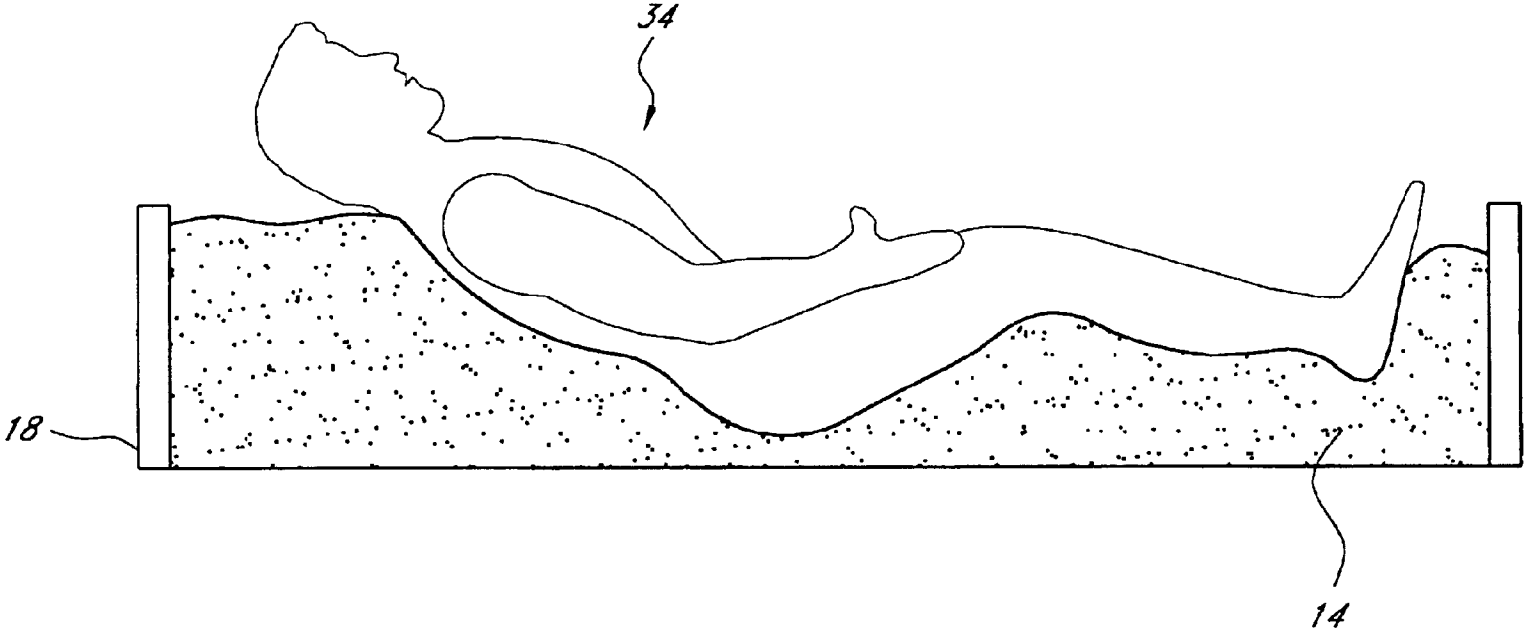
FIG. 7 is another sectional view of the bed illustrated in FIG. 1, illustrating a user lying on the bed with the upper surface of the bed being configured with a contour supporting the user in a recliner-type position.

Finally, as shown in FIG. 7, a user can push the pellets 14 into a contour resembling the seating surface of a reclining-type chair. Due to the friction between the pellets 14, the pellets 14 retain the recliner-type contour, despite the gravitational forces acting on the pellets 14, and despite the weight of the person 34.

In one modification of the bed 10, the frame assembly 12 is left open, without a sheet 24 connected thereto. In this modification, a user can sit or lie down directly on the material 14, such as the pellets described above.

Of course, the foregoing description is that of preferred non-liquid buoyant bedding having certain features, aspects, and advantages in accordance with the present invention. Various changes and modifications also may be made to the above-described non-liquid buoyant bedding without departing from the spirit and scope of the invention, as defined by the claims.

What is claimed is:

1. A bed comprising a frame defining a reservoir having at least a bottom wall and a plurality of sidewalls defining an upward opening, a plurality of beads contained within the reservoir, a stretchable sheet material disposed over the upward opening and the plurality of beads, the beads having a density of about 0.15 of to 1 times the density of water and a coefficient of friction sufficiently low to allow the beads to slide against and flow relative to each other in the reservoir without additional fluidization when a human body is supported on top of the sheet material and by the beads, wherein the buoyant effect provided by the beads is sufficient to support the entire weight of the human body.

2. A bed comprising a plurality of contiguous beads having a density of about 0.15 of to 1 times the density of water; and a substantially rigid frame having sidewalls and a bottom wall configured to support and confine the plurality of beads therein, the plurality of beads having a density sufficient to support a human body through a buoyancy effect caused by the displacement of a volume of beads by the human body, without the need for an additional member for restricting the movement of the beads.

3. The bed according to claim 2, wherein the frame defines an upper opening.

4. The bed according to claim 2, additionally comprising a stretchable sheet secured to the frame and extending over the plurality of beads.

5. The bed according to claim 4, wherein the stretchable sheet is a stretchable material, such as the one sold under the Trademark of Lycra®.

6. The bed according to claim 4, wherein the stretchable sheet is secured to an upper periphery of the upper opening.

7. The bed according to claim 2, wherein a coefficient of friction between the beads is sufficiently low to allow the beads to slide relative to one another when a body is supported by the plurality of beads.

8. The bed according to claim 2, additionally comprising at least one channel member sized to form and interference fit with an upper periphery of the frame.

9. The bed according to claim 8, additionally comprising a stretchable sheet material overlying an upper periphery of the frame, the channel member defining a channel sized to define and interference fit with the upper periphery of the frame and the sheet material.

10. The bed according to claim 2, wherein the plurality of beads are least 2 inches deep.

11. The bed according to claim 2, wherein the plurality of beads are up to 24 inches deep.

12. The bed according to claim 2, wherein the beads are made from a material with a coefficient of friction sufficient to allow the beads to flow against one another when a person is moving on the bed, and sufficient to prevent movement of the beads when the person is at rest on the bed.

13. A bed comprising a plurality of beads having a density of about 0.15 of to 1 times the density of water, and a frame configured to support the plurality of beads, wherein no sheet is disposed over the beads, and the frame is configured to allow a user to sit and lie down on the beads.

14. A bed comprising a substantially rigid frame defining a reservoir having at least a bottom wall and a plurality of sidewalls defining an upward opening, a plurality of contiguous beads supported by and confined within the reservoir of the frame, the plurality of beads having a density sufficient to support a human body to a buoyancy effect created by the displacement of a volume of beads by the human body and an inter-bead friction, without substantial reliance on a device for constraining the movement of the beads to support the body.

15. The bed, according to claim 14, additionally comprising a stretchable sheet secured to the frame and disposed over the plurality of beads.

* * * * *

UNITED STATES PATENT AND TRADEMARK OFFICE

CERTIFICATE OF CORRECTION

PATENT NO. : 6,934,990 B2 
APPLICATION NO. : 10/327326
DATED : August 30, 2005
INVENTOR(S) : Tom Rapisarda It is certified that error appears in the above-identified patent and that said Letters Patent is hereby corrected as shown below:

In Column 2, Line 62, please delete “spreading” and insert --supporting--

In Column 5, Line 43, in Claim 2, please delete “water;” and insert --water,--

In Column 6, Line 41, in Claim 14, after “body”, please insert --due--

Signed and Sealed this

Nineteenth Day of December, 2006

JON W. DUDAS
*Director of the United States Patent and Trademark Office*